US006754457B2

(12) United States Patent
Ciaschi et al.

(10) Patent No.: US 6,754,457 B2
(45) Date of Patent: Jun. 22, 2004

(54) PRE-HEATER FOR AN ELECTROSTATOGRAPHIC REPRODUCTION APPARATUS FUSING ASSEMBLY

(75) Inventors: Andrew Ciaschi, Lima, NY (US); Carl Irvin Bouwens, Leroy, NY (US); James Raymond Flick, Rochester, NY (US)

(73) Assignee: Nexpress Solutions LLC, Rochester, NY (US)

( * ) Notice: Subject to any disclaimer, the term of this patent is extended or adjusted under 35 U.S.C. 154(b) by 605 days.

(21) Appl. No.: 09/828,012

(22) Filed: Apr. 6, 2001

(65) Prior Publication Data

US 2002/0145760 A1 Oct. 10, 2002

(51) Int. Cl.[7] ..... G03G 21/20; G03G 15/20

(52) U.S. Cl. ..... 399/92; 399/320; 399/328; 399/335

(58) Field of Search ..... 399/92, 320, 322, 399/328, 329, 335, 341, 400

(56) References Cited

U.S. PATENT DOCUMENTS

| | | | | |
|---|---|---|---|---|
| 4,071,735 A | | 1/1978 | Moser | 219/216 |
| 4,248,520 A | * | 2/1981 | Kurita et al. | 399/92 |
| 4,733,272 A | * | 3/1988 | Howe et al. | 399/335 X |
| 4,959,529 A | | 9/1990 | Matsumoto et al. | 219/388 |
| 5,086,209 A | * | 2/1992 | Kintz et al. | 399/92 X |
| 5,412,459 A | | 5/1995 | Borsuk et al. | |
| 5,521,688 A | | 5/1996 | Moser | |
| 5,784,679 A | | 7/1998 | Schlueter, Jr. et al. | 399/335 |
| 5,842,098 A | * | 11/1998 | Ueno et al. | 399/322 |
| 5,983,063 A | * | 11/1999 | De Niel et al. | 399/335 |
| 6,026,275 A | * | 2/2000 | Matsuzoe et al. | 399/335 |

* cited by examiner

*Primary Examiner*—Sandra Brase
(74) *Attorney, Agent, or Firm*—Lawrence P. Kessler

(57) ABSTRACT

A pre-heater for a fusing assembly for an electrostatographic reproduction apparatus, in which an image-wise pattern of pigmented marking particles is fixed to a receiver member transported along a travel path in operative relation with said fusing assembly. The pre-heater as described includes a housing defining an internal chamber. The housing internal chamber defines an opening adjacent to the receiver member travel path. A heating element is located within the housing internal chamber. An airflow system is provided including a blower, and a distribution plenum in flow communication between the blower and the heating element. An impingement member is positioned in the chamber opening adjacent to said travel path. An impingement plenum is in flow communication between the heating element and the impingement member, and a return conduit is in flow communication between the opening and the blower. Accordingly, air from the blower is delivered through and heated by the heating element, impinges upon a receiver member bearing a marking particle image in the opening, and is returned to the blower while being substantially prevented from escaping from the chamber.

20 Claims, 7 Drawing Sheets

PRE-HEATER FOR AN ELECTROSTATOGRAPHIC REPRODUCTION APPARATUS FUSING ASSEMBLY

FIELD OF THE INVENTION

This invention relates in general to a fusing assembly for an electrostatographic reproduction apparatus, and more particularly to an electrostatographic reproduction apparatus fusing assembly, which includes a pre-heater.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fusing device for typical electrographic reproduction apparatus includes at least one heated roller, having an aluminum core and an elastomeric cover layer, and at least one pressure roller in nip relation with the heated roller. The fusing device rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

Certain reproduction apparatus recently introduced into the market have been designed to produce multi-color copies. In such reproduction apparatus, multiple color separation images are respectively developed with complementary colored marking particles, and then transferred in superposition to a receiver member. It has been found that fixing of multi-color marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impair legibility, a matte finish is preferred.

It is known that the glossiness of a marking particle image is, at least in part, dependent upon the marking particle melting characteristics in the fixing process. In general, the fixing apparatus serves to soften or at least partially melt the marking particles, enabling the marking particles to permeate into the fibers of the receiver member so that the marking particles are fixed to the receiver member to give a glossy image reproduction. For example, the fixing apparatus may include a heated roller which contacts the marking particles and the receiver member. With multi-color marking particle images, the multiple color marking particle images are respectively melted and fixed by the heated roller. If the color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy. Therefore low melting point marking particles are used. They yield few cavities and a hard flat surface so as to give glossy and vivid colors in the reproduction.

Low melting point marking particles are subject to increased image offset to the heating roller. This can produce undesirable defects in the reproduction or subsequent reproductions. Although image offset can be reduced by application of fusing oil to the heating roller, the use of such oil introduces further complications into the fusing system, such as handling of the oil and making sure that the layer of oil on the roller is uniform. Alternatively, a mechanical arrangement for reducing image offset, without the need for fusing oil, has been found. Such mechanical arrangement provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing, but is not particularly suitable for black image fusing.

In color electrophotographic reproduction apparatus, generally using a nip forming roller fusing, it has been found that an increase in fusing roller speed, facilitates the matching of image-gloss to paper-gloss, and also serves to reduce differential gloss. U.S. Pat. No. 5,521,688 (issued May 28, 1996) describes a radiant oven prior to two pairs of glossing rollers. The radiant oven fixes the marking particles (resulting in a matte image), and then increases the gloss by heat and pressure while passing through the glossing rollers. Without the use of a pre-heater, fusing speed generally limited, and there is thus a limited capability to match image gloss to paper gloss. Other patents describing pre-heating systems in electrophotographic fusers include U.S. Pat. No. 4,959,529 (issued Sep. 25, 1990); U.S. Pat. No. 5,784,679 (issued Jul. 21, 1998); U.S. Pat. No. 5,412,459 (issued May 2, 1995); and U.S. Pat. No. 4,071,735 (issued Jan. 31, 1978).

SUMMARY OF THE INVENTION

This invention is directed to a pre-heater for a reproduction apparatus fusing assembly which utilizes hot-air impingement to transfer heat to an image-wise marking particle pattern on a receiver member. The pre-heater includes a housing defining a heating chamber. The heating chamber defines an opening adjacent to the receiver member travel path. A heating element is located within the housing. An airflow system is provided including a blower, and a distribution plenum in flow communication between the blower and the heating element. An impingement member is positioned in the chamber opening adjacent to said travel path. An impingement plenum is in flow communication between the heating element and the impingement member, and a return conduit is in flow communication between the opening and the blower. Accordingly, air from the blower is delivered through and heated by the heating element, impinges upon a receiver member bearing a marking particle image in the opening, and is returned to the blower while being prevented from escaping from the chamber.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

This invention uses a pre-heater unit in an electrostatographic reproduction apparatus to increase roller-fusing capabilities as to both speed, and gloss control. The pre-heater unit provides for impingement of hot air onto a receiver member bearing a marking particle image developed thereon by the reproduction apparatus. Specific features of the hot air pre-heater unit that enable the practical use of hot air are fully described below. The hot air, due to these features, is contained within the pre-heater unit which substantially eliminates the heat emission to the reproduction apparatus environment. Containment of the air within the unit also maximizes thermal efficiency by re-circulating the spent air after it has transferred most of its heat to an image-bearing receiver member. The spent air is at a lower temperature than the hot impinging air, but is not as cool as the surrounding ambient air. While prior disclosures have contended that preheating can remove moisture from cellulose substrates, and a roller fusing can thus run its fusing roller surface temperature at a reduced set point of 300° F., this disclosure provides that gloss can be controlled and fusing roller speeds can be increased when using a pre-heater unit, and differential gloss from 30% coverage and up can be reduced.

Figure 1:
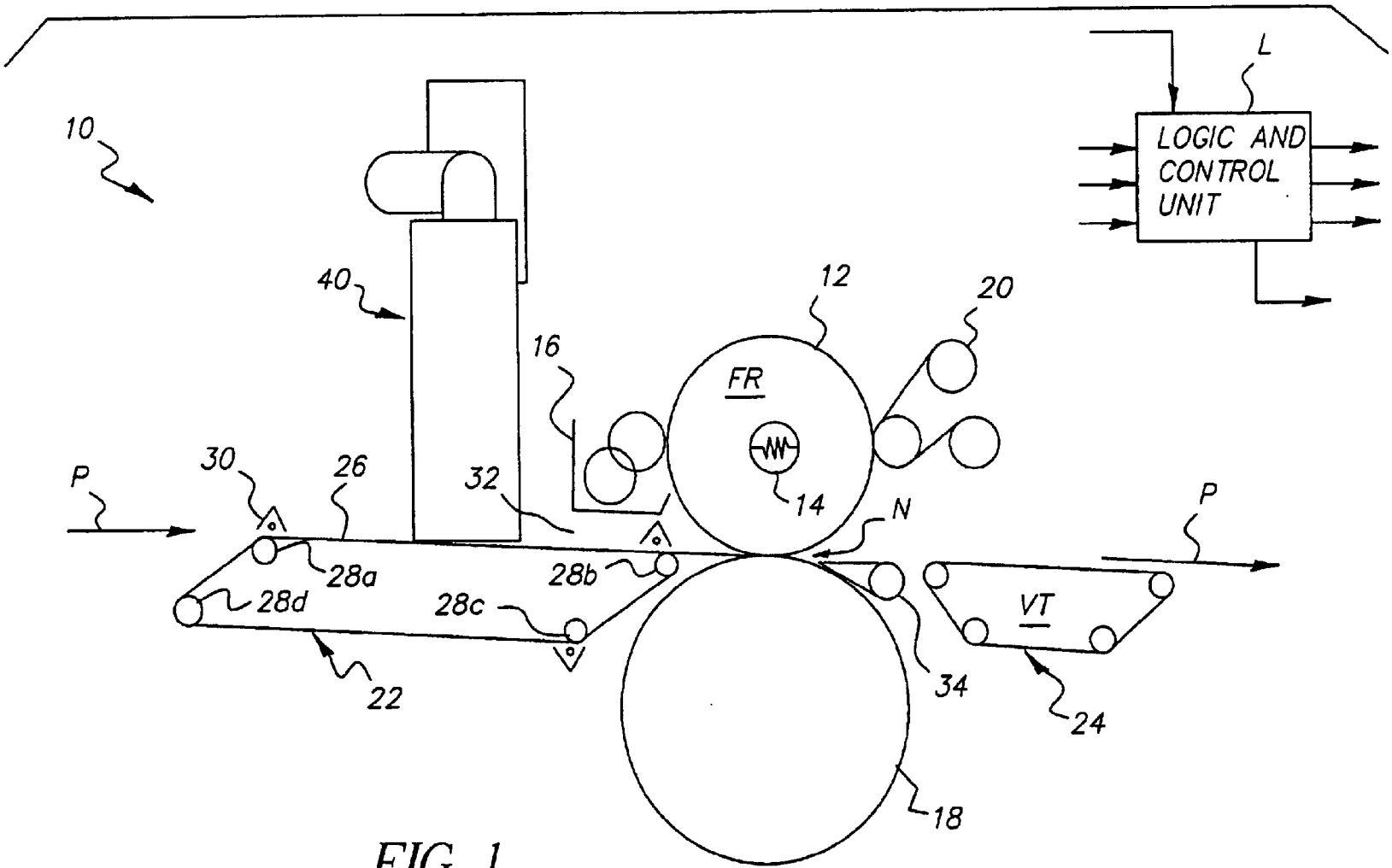
FIG. 1 is a schematic side elevational view of an electrostatographic reproduction apparatus fusing assembly including a pre-heater unit according to this invention.
Figure 2:
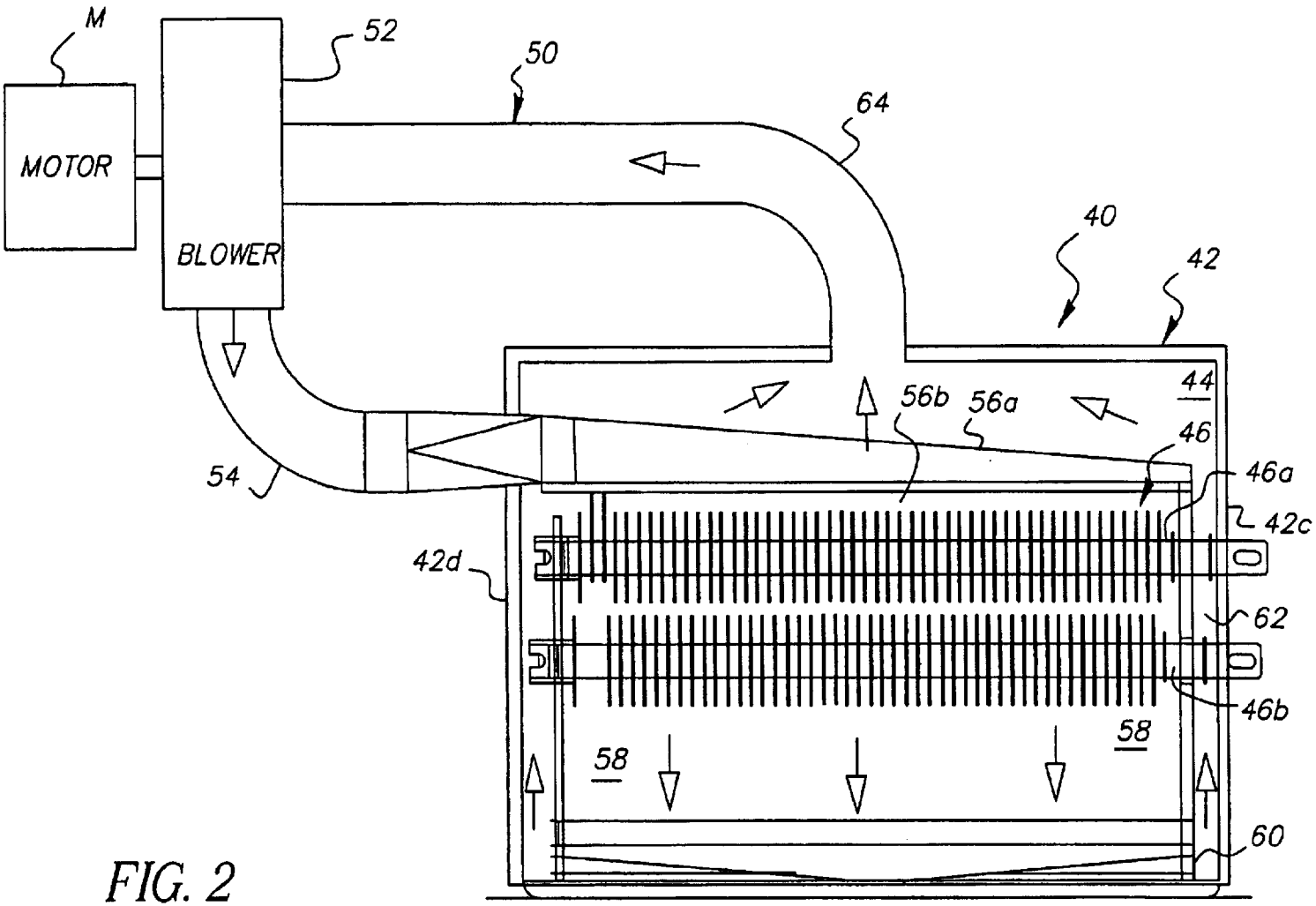
FIG. 2 is a front elevation view, on an enlarged scale, of the fusing assembly pre-heater unit of FIG. 1, partly in cross-section with portions removed to facilitate viewing.
Figure 3:
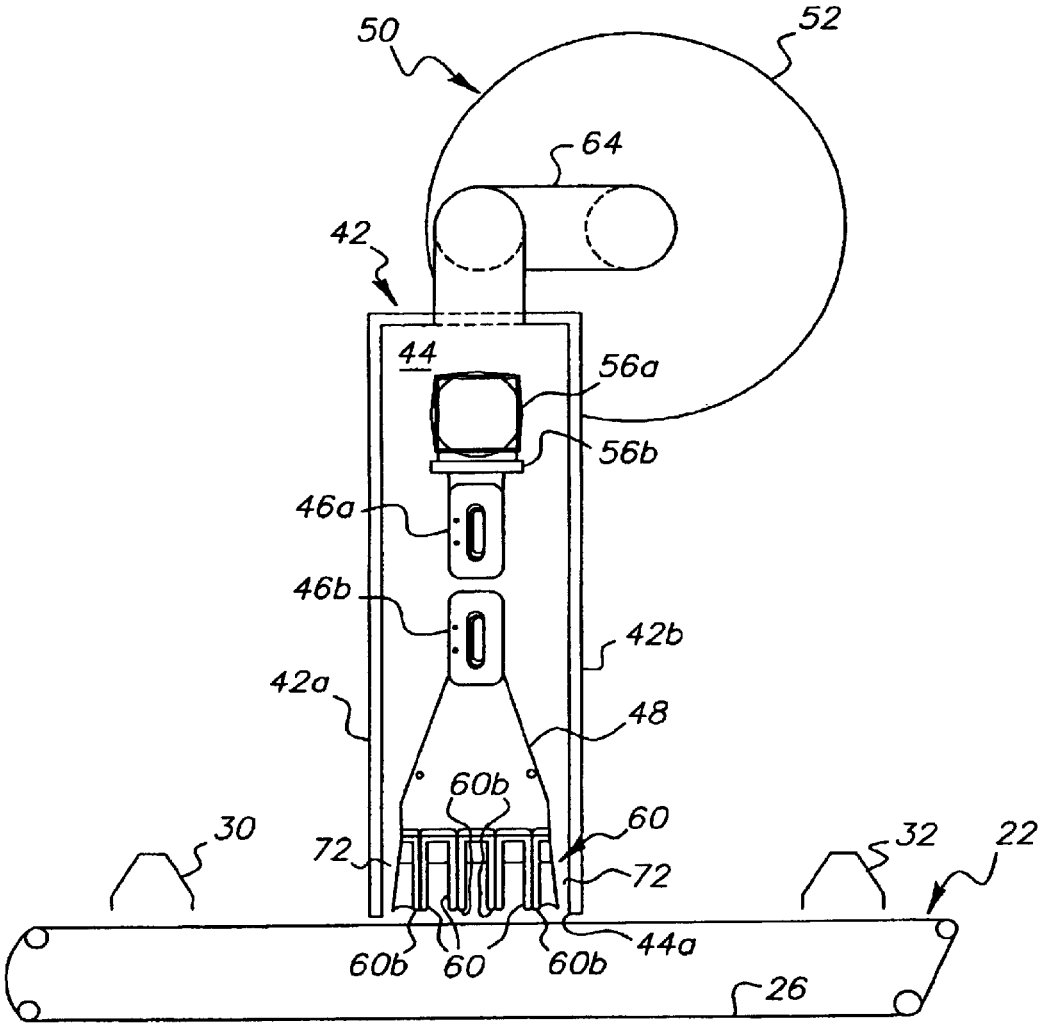
FIG. 3 is a side elevational view, on an enlarged scale, of the fusing assembly pre-heater unit of FIG. 1, partly in cross-section with portions removed to facilitate viewing.

Referring now to the accompanying drawings, FIG. 1 schematically illustrates an electrostatographic reproduction apparatus fusing assembly, designated generally by the numeral 10. The fusing assembly 10 includes a fusing roller 12 having a rubber outer layer on a hollow heat conductive core such as aluminum or steel. A lamp 14, located internally of the core of the fusing roller 12, provides the necessary heat to the roller to raise the temperature thereof to a degree required to at least soften a marking particle image-wise pattern on the receiver member to fuse the marking particle image to the receiver member. Of course an external heater for the fusing roller 12 is also suitable for use with this invention.

An oilier mechanism 16 is located in operative association with the fusing roller 12 to apply a release oil coating to the roller. Such release oil coating will serve to inhibit the sticking of marking particles to the fusing roller. A pressure roller 18, having a hard surface, is located in nip relation with the fusing roller 12. Any suitable mechanism (not shown) selectively applies a force to create a pressure in the nip N between the pressure roller 18 and the fusing roller 12 to effect the fusing of the marking particle image to the receiver member as the receiver member passes through the nip. A cleaning mechanism 20 engages the fusing roller 12 to clean the surface thereof. If required, a similar cleaning mechanism may be provided to engage the pressure roller to clean the surface thereof.

The receiver member, bearing an image-wise marking particle pattern, is transported by a suitable transport arrangement in the noted direction along a path (designated by the letter P) through the fusing nip N between the fusing roller 12 and the pressure roller 18 by a pre-fusing transport 22 and a post-fusing transport 24. The receiver member transport arrangement serves to assure that the receiver member is properly delivered to and transported away from the fusing nip N for optimum fusing efficiency. While any particular transport arrangement is suitable for use with this invention, it is preferred that the pre-fusing transport 22 be an electrostatic web transport, and the post-fusing transport 24 be any well-known vacuum transport.

The electrostatic web transport of the pre-fusing transport 22 includes an endless web 26 formed in part, for example, of dielectric material so as to enable the web to hold a charge. The web is, for example, a belt made of Kapton® (a polyimide material used for belt fusing). The web 26 is supported by rollers 28*a*–28*d*, at least one of which is driven, for movement about a closed loop path in operative relation with the receiver member travel path P. At the entrance to the run of the web 26 coincident with the travel path P, a tack down charger 30 is provided on the opposite side of the path from the web. The charger 30, at a predetermined time, provides an appropriate corona charge to tack a receiver member fed along the path P by any suitable upstream transport mechanism (not shown) to the web 26 for movement therewith. Adjacent to the fusing nip N, a detack charger 32 is provided to apply an appropriate corona charge to facilitate detack of the receiver member from the web 26 and enable it to move properly through the fusing nip. A skive member 34, downstream of the fusing nip N in the process direction, assures that the receiver member exits the fusing nip and is properly received by the vacuum transport post fusing transport 24 for transport to an appropriate downstream location (not shown).

Appropriate sensors (not shown) of any well known type, such as mechanical, electrical, or optical for example, are utilized to provide control signals for the fusing assembly 10 and associated receiver member transport mechanisms. Such sensors are located along the receiver member travel path and detect the location of a receiver member in its travel path, and respectively produce appropriate signals indicative thereof. Such signals are fed as input information to a logic and control unit L including a microprocessor, for example. Based on such signals and a suitable program for the microprocessor, the unit produces signals to control the timing operation. The production of a program for a number of commercially available microprocessors, which are suitable for use with the invention, is a conventional skill well understood in the art. The particular details of any such program would, of course, depend on the architecture of the designated microprocessor.

According to this invention, the efficiency of the fusing assembly 10, and the ability to more closely match image gloss to paper gloss, is improved by providing a pre-heater unit designated generally in the drawings by the numeral 40. The pre-heater unit 40, as best seen in FIGS. 2–5, includes a housing 42 located opposite the run of the pre-fusing transport electrostatic transport web 26 coincident with the receiver member travel path P. The housing 42 includes upstanding lead and trail side walls 42*a*, 42*b* transverse to the direction of receiver member transport in the travel path P (i.e., spanning the travel path), and upstanding outboard side walls 42*c*, 42*d* opposite outboard marginal edges of the travel path in the transport direction. The housing side walls define an internal chamber 44, and generally define an opening 44*a* adjacent to the receiver member travel path. A heating element 46 is supported within the internal chamber 44 of the housing. The heating element 46 includes at least one resistive heater cell (in the preferred embodiment of the drawings two cells 46*a*, 46*b* are shown). The resistive heating cells have heat conductive fins 48 (for example, steel fins) extending therefrom to optimize the heat transferred from the resistive heating cells to an airflow passing over the cells and through the fins in the manner explained hereinbelow.

Further the pre-heater unit 40 according to this invention includes an airflow system 50 for directing heated air for impingement upon marking particle image-bearing receiver members transported by the electrostatic web 26 of the pre-fusing transport 22. The airflow system 50 includes a blower 52, such as a two-stage radial fan, driven by any suitable motor M. A conduit 54 connects the output from the blower 52 to a distribution plenum 56*a* supported by a distribution plate 56*b* located within the chamber 44 of the pre-heater unit housing 42 adjacent to the heating element 46. An impingement plenum 58 provides an airflow path from the heating elements 46*a*, 46*b* to an impingement member 60 located within the chamber 44. The impingement member 60 includes a plurality of nozzles 60*a*, which define a plurality of airflow slots 60*b* respectively. The slots 60*b* of the nozzles 60*a* are oriented transversely to the direction of receiver member travel in the travel path P and direct a flow of air as jets through the respective slots 60*b* at the receiver member travel path. The air jets impinge upon an image-bearing receiver member transported along the path by the electrostatic web 26 of the pre-fusing transport 22. Accordingly, air from the blower 52 is delivered through, and heated by, the heating elements 46*a*, 46*b*. It is thereafter directed in jets to impinge upon a receiver member bearing a marking particle image as it is transported passed the housing chamber opening 44*a*. The improved results obtained by such hot air impingement pre-heater unit 40 of the described construction is fully discussed below.

Figure 4:
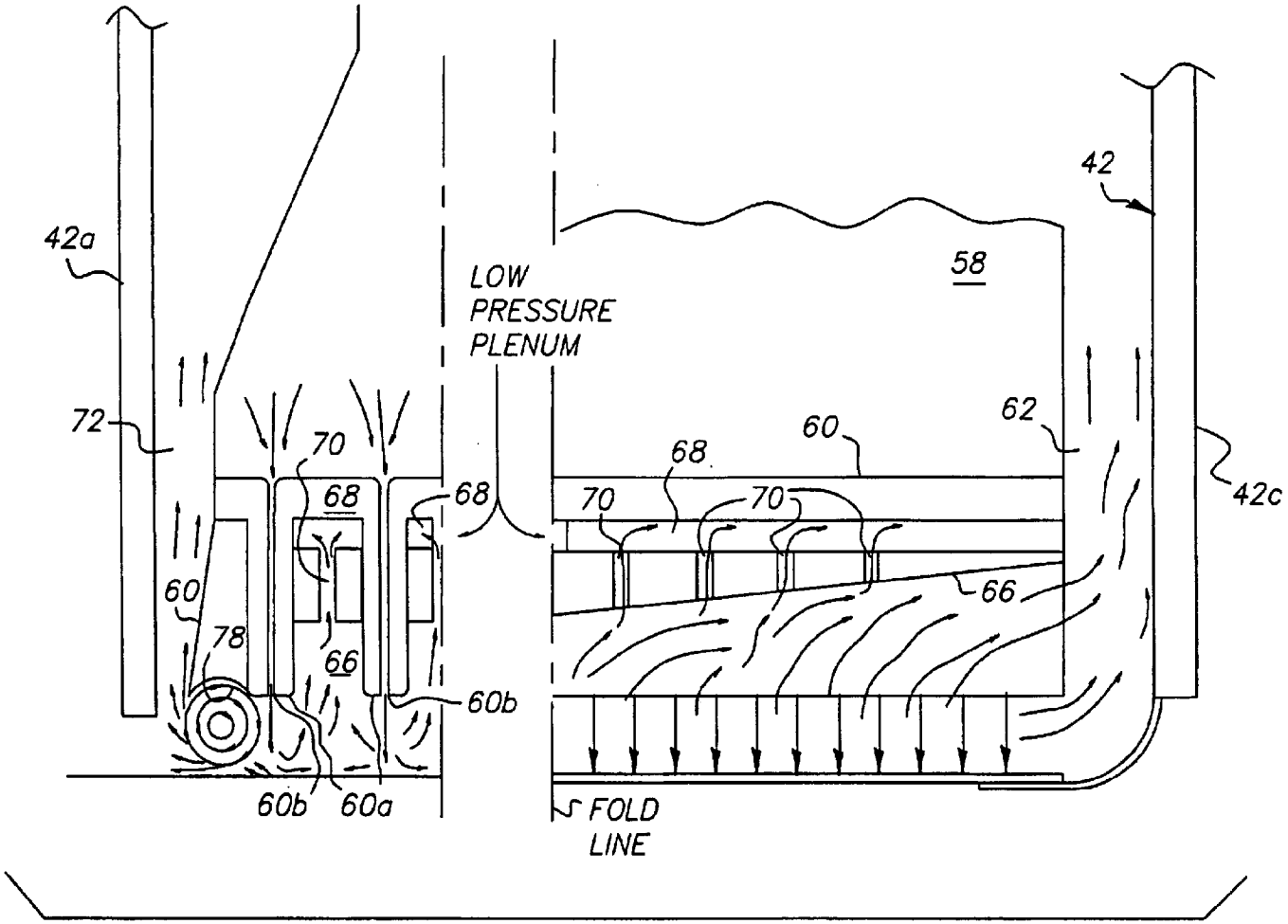
FIG. 4 is a side elevational view, on a still further enlarged scale, of the fusing assembly pre-heater unit of FIG. 3, particularly showing the spent air recirculation ramps thereof.

To complete the construction of the pre-heater unit 40 in a manner to substantially prevent contamination of the environment of the electrostatographic reproduction apparatus, spent airflow is returned to the blower 52 while being substantially prevented from escaping from the chamber 44. Basically, there are two different paths over which the spent air flows as it is being returned after impingement upon an image-bearing receiver member, through the space between the heating elements 46*a*, 46*b* and housing 42, back to the blower 52. As shown in FIG. 4, one airflow path 72 (left side of the drawing) is established at the lead and trail sides of the housing 42 (adjacent to the walls 42*a* and 42*b* respectively) in the direction of receiver member transport. The other airflow path (right side of the drawing) is defined by a plurality of return channels 66 located parallel to the slots 60*b* of the nozzles 60*a* to the outside of the heating element 46, at the outboard marginal edges of the receiver member transport path. The return channels 66 are arranged so as to span the receiver member transport path. Each of the channels is tapered, vertically. The lowest (elevation) point for the channels is found in the center of the transport path, and the highest point is at the outer marginal edges of the transport path. Additionally, a low-pressure plenum 68 communicates through ports 70 with the return channels 66. Return spaces 62 (see FIGS. 2 and 4) within the chamber 44 (adjacent to walls 42*c* and 42*d* respectively) is in flow communication with the return channels 66, the low pressure plenum 68, and the opening 44*a* of the chamber 44 to the receiver member travel path P. The return spaces 62 connect to a conduit 64, which is subsequently connected to the input for the blower 52. As such, the differential airflow pressures (as noted in FIG. 5) force the spent air from the center of the receiver member transport path area to the edges of the transport path and into the return spaces 62.

Figure 5:
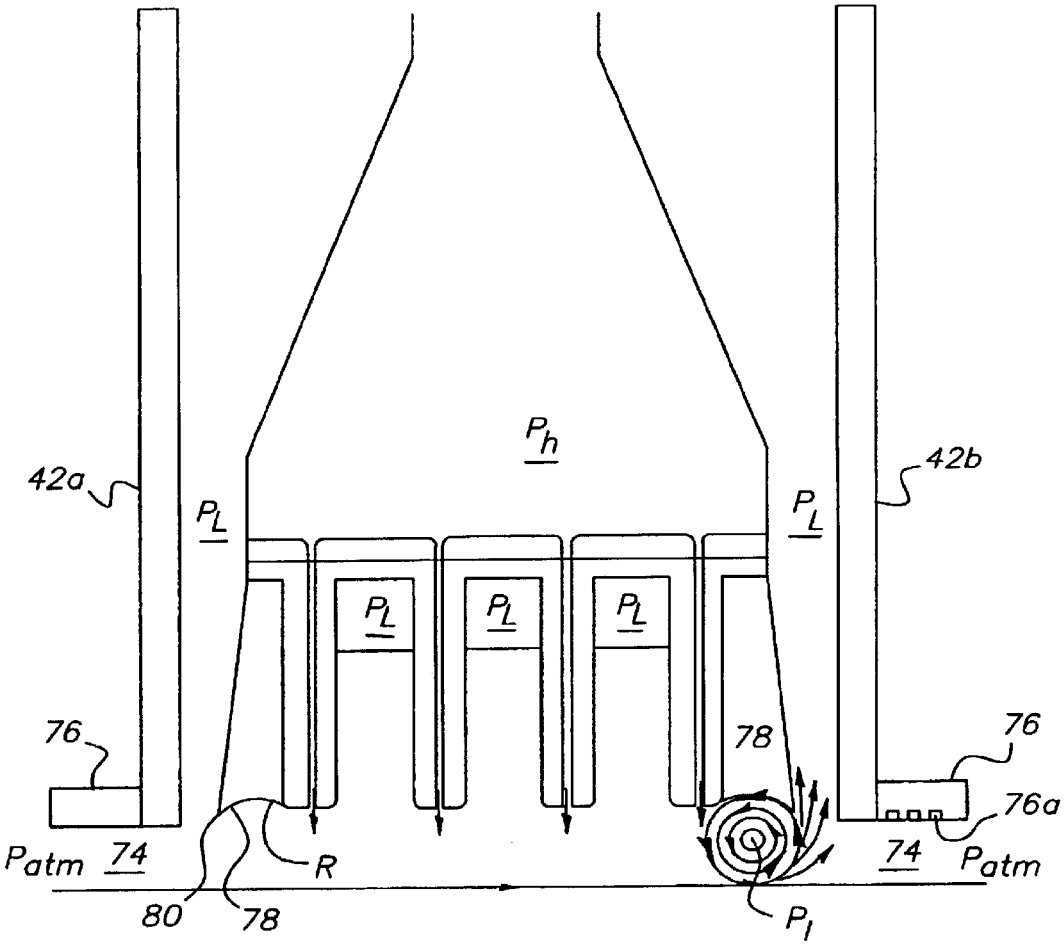
FIG. 5 is a side elevational view, on a still further enlarged scale, of the fusing assembly pre-heater unit of FIG. 3, particularly showing the flow containment features thereof.

As best seen in FIGS. 4 and 5, the impingement member 60 forms vortex generators, designated generally by the numeral 78, adjacent to the airflow return paths 72 at the lead and trail sides of the housing 42. The purpose of the vortex generators 78 is to contain the hot air within the confines of the housing 42 of the pre-heater unit 40. There are five important aspects necessary to enable the vortex generator 78 to create the desired airflow-containing vortex. First is the impinging jet of hot air provided by the nozzle 60*a* immediately adjacent to the respective vortex generator 78; second is the barrier created by the web 26 of the transport 22 for the receiver members; third is the radius R defined by the impingement member 60 extending from the nozzle jet to the edge of the impingement member; fourth is the knife-edge 80, at the terminus of the radius R, at the outer edge of the impingement member; and fifth is the low-pressure area between the impingement member 60 and the housing 42. Accordingly, airflow in each of the regions adjacent the return paths 72 form a vortex which has a lower pressure than the area between the impingement member 60 and the housing 42, and the atmospheric (or ambient) pressure of the environment surrounding the housing (see the pressure relationships as noted in FIG. 5). This pressure $P_1$ is the force that restrains the airflow from escaping from the housing 42. Further, the knife edges 80 respectively aid in directing the airflow into the return paths 72 for returning the air to the blower 52.

Optionally, additional features are provided to aid in containing the air within the housing 42 of the pre-heater unit 40. The additional features include tunnels 74 (see FIG. 5) at the lead and trail side walls 42*a*, 42*b* of the pre-heater unit 40. The tunnels 74 are formed by respective members (or ceilings) 76 that extend away from the pre-heater unit, at the lower edges of the lead and trail side walls of the housing 42 spaced from and parallel to the receiver member travel path. The members 76 my have a ground or labrynthed configuration (designated by numeral 76*a*). This creates input and output tunnels that serve to increase airflow resistance.

Figure 6:
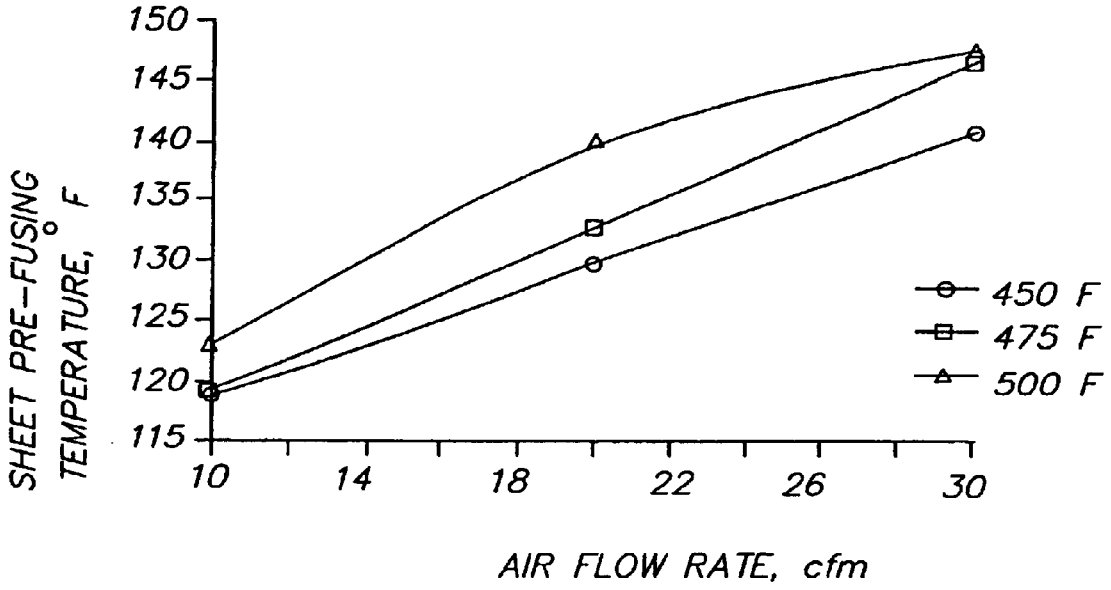
FIG. 6 is a graphical representation of the change in sheet temperature with the change in airflow rate through the pre-heater unit according to this invention.
Figure 7:
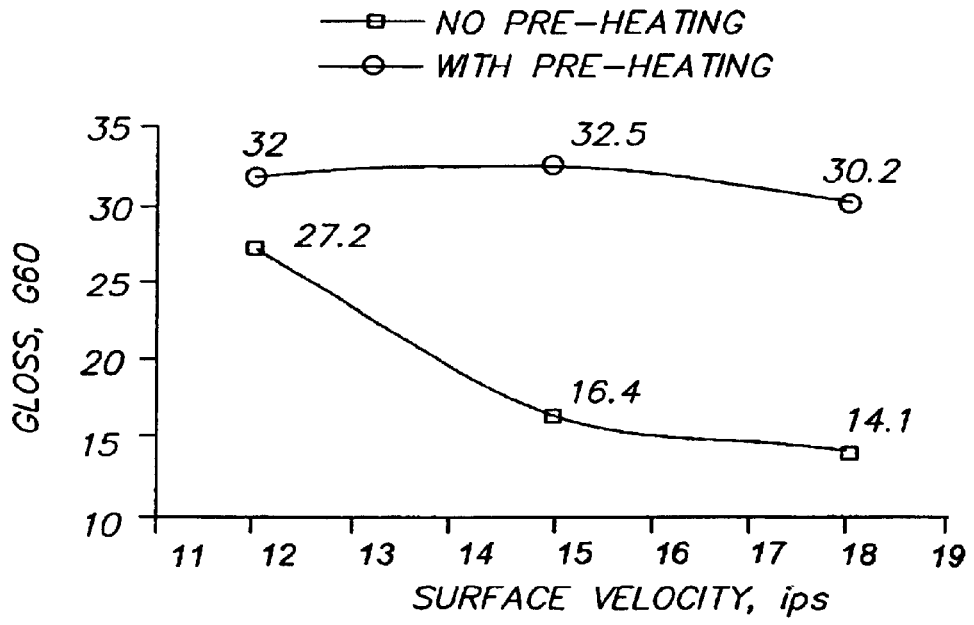
FIG. 7 is a graphical representation showing the effects on image gloss based on process speed and use of a pre-heater unit according to this invention.
Figure 8:
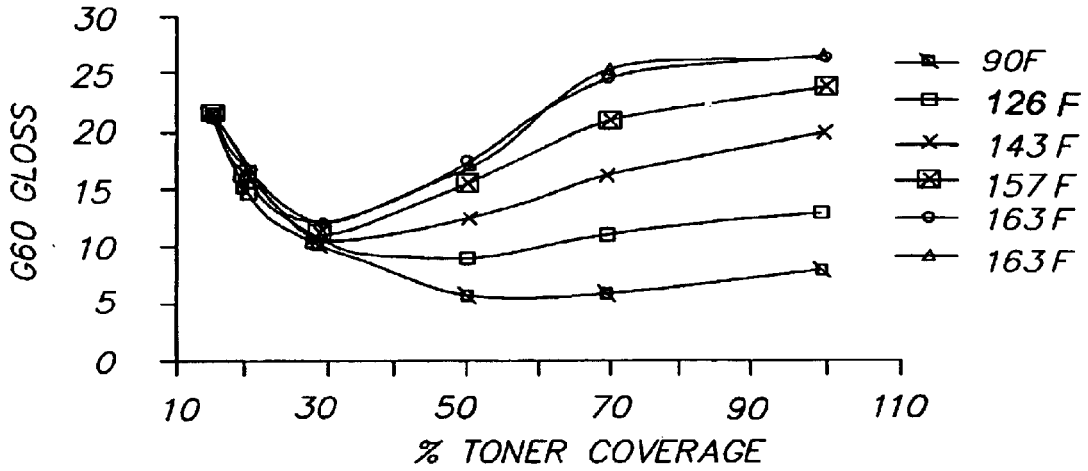
FIG. 8 is a graphical representation showing the effects on image gloss based on % marking particle coverage and use of a pre-heater unit according to this invention.
Figure 9:
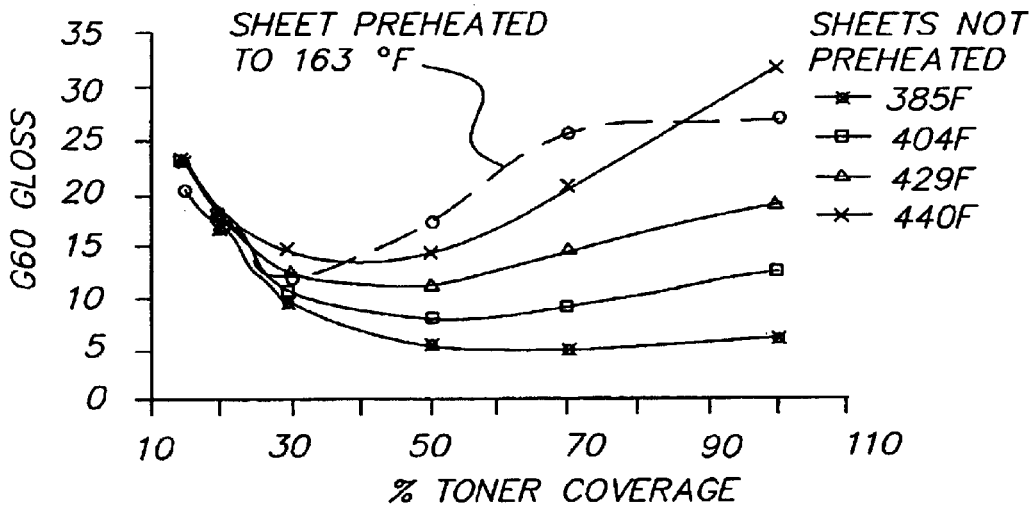
FIG. 9 is a graphical representation showing the effects on image gloss based on fusing roller temperature and use of a pre-heater unit according to this invention.

As noted above, the pre-heater unit 40 according to this invention enables a fusing assembly of an electrostatographic reproduction apparatus to exhibit improved speed and gloss control. Referring to the drawings, FIG. 6 is a graphical representation of data showing a receiver member (sheet) temperature response, with respect to volumetric-airflow, from a heat gun. Each curve represents a different air temperature parameter. FIG. 7 shows the gloss response data with respect to fusing speed, or receiver member transport velocity. The curve labeled "No Pre-heating" shows a drop in gloss as the receiver member transport velocity (process speed) increases. With preheating, the gloss remains essentially constant as speed is increased. FIGS. 8 and 9 show the different shapes of the resulting gloss curves with respect to marking particle percent coverage, which is directly proportional to marking particle stack height. Stack heights are in general also directly proportional to gloss, but is inversely proportional at very small stack heights.

It has been found that in general the higher the coverage, or stack height, of marking particles on a receiver member, the higher the gloss. FIG. 8 shows data resulting from a preheating experiment. The roller fusing set points remained constant throughout this experiment; but the receiver member initial temperature was increased from ambient (90° F.) to 163° F. Each curve represents a particular receiver member initial temperature. FIG. 9 shows the effect of changing the roller fusing set points (the fusing roller surface temperature, specifically) from 385° F. to 440° F.; while leaving the receiver member initial temperature constant. One curve was added to compare "preheating" versus "not preheating", with a preheated initial temperature of 163° F. The fusing roller surface set point temperature was 385° F.; the same condition at which the curve labeled 385° F. was processed. It is apparent from the graph that there are substantial different shapes for the two curves, even though the roller fusing set points were identical. If fusing conditions were set to obtain the same gloss at 0% to 10% coverage and at 100% coverage, there is a reduction in differential gloss in the coverage range from 30% to 100%.

Impingement of hot air on a marking particle image-bearing receiver member by the pre-heater unit 40 according to this invention results in the highest possible heat transfer rates for transferring heat from air to surface because it breaks the laminar layer that inhibits heat transfer. However, impinging air, at useful velocities, has the possibility of disturbing the positioning of a passing receiver member. The high and low pressure regions would tend to lift the receiver member from the transport if not held down well enough; and due to a drying effect, a paper substrate would tend to shrink and cockle if not properly constrained. The electrostatic web 26 of the transport 22 solves these receiver member handling problems, when used in conjunction with the pre-heater unit 40. The electrostatic web temperature is controlled by air knives.

In conjunction with the hot air pre-heater unit 40, the above-described electrostatic transport 22, using a polyimide web 26, has advantages over prior vacuum transports and air cushion transports. The polyimide web is smooth and the electrostatic force holds the substrate well enough so that it does not distort or lift during the preheating process. The smoothness and continuous form of the web allows even heat distribution over the entire sheet, by having consistent thermo-physical properties over the entire sheet. A vacuum transport belt has holes for the vacuum to act on the sheet being transported. These holes create an area of lower thermal resistance thus cooling the sheet in those areas more than in areas without holes. This behavior leaves behind a thermal history that can be detected in the fusing and surface finish qualities of a print. Air cushion transport systems float paper on an air cushion, but do not hold sheet with any substantial force. Without a substantial force to hold the sheet, the sheet will shrink cockle, and curl during the preheating process.

Re-cycling of the air for the pre-heater unit 40 according to this invention is the most efficient method of heating such air. Air heating is very power intensive due to its low heat capacity; accordingly, re-cycling of the air returns air to the heating element (element 46) at an elevated temperature (close to the output temperature of the hot air). Re-cycling is very important, and prior to the described pre-heater arrangement of this invention was difficult to achieve. Further, the re-cycling of hot air by the described arrangement for the pre-heater 40 also serves to substantially prevent heat emission from the housing 42 into the surrounding environment.

The pre-heating process itself serves to enable selective change of receiver member temperatures prior to the roller fusing process. The necessary energy for efficient and proper roller fusing is defined by time the receiver member spends in the fusing nip and the temperature of the fusing roller. However, roller fusers are naturally limited, at least in part, by roller material maximum operating temperatures, heating methods, size, and cost. Thus, by raising the receiver member input temperature, a roller fusing's operational capability range can be increased without increasing the roller temperatures or nip time (which under certain conditions would push a fusing beyond its limits). Accordingly, this raising of the receiver member input-temperature enables the roller fusing to increase its speed by delivering part of the energy necessary for fusing to the receiver member before the receiver member is acted on by the roller fusing.

The ability to change receiver member (and marking particle image) temperature prior to the roller fusing process enables marking particle melt flow control (i.e., gloss control). It has been determined that gloss is directly proportional to fusing energy and fusing roller roughness. Thus, a receiver member having an input temperature at room temperature would result in a certain gloss level. Increasing the receiver member input temperature, higher than room temperature, would then result in a higher gloss level, for the same roller fusing conditions. Reducing differential gloss (i.e., the gloss of the receiver member vs. the gloss of the fused marking particles) can be achieved by increasing the time scale of the fusing process. That is, increasing the time scale increases the time that the molten marking particles can flow. The time scale of prior roller fusing nips was anywhere from 10 ms to 100 ms. However, with a pre-heater unit according to this invention, the time scale can be increased anywhere from 200 ms to 500 ms.

The invention has been described in detail with particular reference to certain preferred embodiments thereof, but it will be understood that variations and modifications can be effected within the spirit and scope of the invention.

What is claimed is:

1. In a fusing assembly for an electrostatographic reproduction apparatus, in which an image-wise pattern of pigmented marking particles is fixed to a receiver member transported along a travel path in operative relation with said fusing assembly, said fusing assembly including a pre-heater for facilitating efficient fusing assembly operation and gloss control, said pre-heater comprising:

a housing defining an internal chamber open adjacent to said receiver member travel path;

a heating element within said housing internal chamber;

an airflow system including a blower, a distribution plenum in flow communication between said blower and said heating element, an impingement member in said chamber opening adjacent to said travel path, an impingement plenum in flow communication between said heating element and said impingement member, and a return conduit in flow communication between said opening and said blower, whereby air from said blower is delivered through and heated by said heating element, impinges upon a receiver member bearing a marking particle image in the opening and is returned to said blower while being substantially prevented from escaping from said chamber.

2. The fusing assembly pre-heater according to claim 1 wherein said heating element includes at least one resistive heater cell.

3. The fusing assembly pre-heater according to claim 1 wherein said heating element includes a pair of resistive heater cells respectively including a plurality of conductive fins to provide increased heat transfer properties to said heater cells.

4. The fusing assembly pre-heater according to claim 1 wherein said impingement member includes a plurality of airflow nozzles.

5. The fusing assembly pre-heater according to claim 4 wherein said impingement member defines a plurality of airflow return channels located between said airflow nozzles.

6. The fusing assembly pre-heater according to claim 5 wherein said airflow nozzles respectively define air jet slots oriented transverse to the direction of receiver member travel along said travel path, and said airflow return channels are oriented parallel to said air jet slots.

7. The fusing assembly pre-heater according to claim 5 wherein said impingement member further includes a low pressure plenum in flow communication with said airflow return channels and said return conduit.

8. The fusing assembly pre-heater according to claim 1 wherein said impingement member defines a plurality of airflow return channels located between said airflow nozzles, said airflow nozzles respectively defining air jet slots oriented transverse to the direction of receiver member travel along said travel path, and said airflow return channels are oriented parallel to said air jet slots, and said impingement member further including a low pressure plenum in flow communication with said airflow return channels and said return conduit.

9. The fusing assembly pre-heater according to claim 1 wherein said pre-heater housing includes lead and trail side walls oriented transverse to the direction of travel of a receiver member along said travel path, and outboard side walls opposite outboard marginal edges of said travel path, and wherein said return conduit includes airflow paths respectively defined in said internal chamber adjacent to said lead and trail side walls and said outboard side walls.

10. The fusing assembly pre-heater according to claim 9 wherein said impingement member further includes a mechanism for forming an airflow vortex respectively adjacent to said lead and trail side walls of said pre-heater housing.

11. The fusing assembly pre-heater according to claim 10 wherein said vortex-forming mechanism includes respective radius sections located immediately adjacent to, and extending from, said air flow nozzles closest to said lead and trail side walls, the end of each radius section remote from said respective nozzle forming a knife edge.

12. In a fusing assembly for an electrostatographic reproduction apparatus, in which an image-wise pattern of pigmented marking particles is fixed to a receiver member transported along a travel path in operative relation with said fusing assembly, said fusing assembly comprising:

a fusing member, located adjacent to said receiver member travel path for heating pigmented marking particles to a degree sufficient to tack such marking particles to a receiver member transported along said travel path;

a pre-fusing transport for transporting receiver members to said fusing member; and a pre-heater, for facilitating efficient fusing assembly operation and gloss control, including a housing defining an internal chamber open adjacent to said receiver member travel path opposite said pre-fusing transport, a heating element within said housing internal chamber, an airflow system including a blower, a distribution plenum in flow communication between said blower and said heating element, an impingement member in said chamber opening adjacent to said travel path, an impingement plenum in flow communication between said heating element and said impingement member, and a return conduit in flow communication between said opening and said blower, whereby air from said blower is delivered through and heated by said heating element, impinges upon a receiver member bearing a marking particle image in the opening and is returned to said blower while being substantially prevented from escaping from said chamber.

13. The fusing assembly according to claim 12 wherein said pre-fusing transport includes a dielectric web, and a charger to apply a charge to said dielectric web sufficient to tack a receiver member thereto for transport therewith.

14. The fusing assembly according to claim 13 wherein said heating element of said pre-heater includes at least one resistive heater cell, and said at least one resistive heater cell includes a plurality of conductive fins to provide increased heat transfer properties to said heater cell.

15. The fusing assembly according to claim 13 wherein said impingement member of said pre-heater includes a plurality of airflow nozzles, a plurality of airflow return channels located between said airflow nozzles, and wherein said airflow nozzles respectively define air jet slots oriented transverse to the direction of receiver member travel along said travel path, and said airflow return channels are oriented parallel to said air jet slots.

16. The fusing assembly according to claim 15 wherein said impingement member further includes a low pressure plenum in flow communication with said airflow return channels and said return conduit.

17. The fusing assembly according to claim 13 wherein said pre-heater housing includes lead and trail side walls oriented transverse to the direction of travel of a receiver member along said travel path, and outboard side walls opposite outboard marginal edges of said travel path, and said return conduit includes airflow paths respectively defined in said internal chamber adjacent to said lead and trail side walls and said outboard side walls.

18. The fusing assembly according to claim 17 wherein said impingement member further includes a mechanism for forming an airflow vortex respectively adjacent to said lead and trail side walls of said pre-heater housing.

19. The fusing assembly according to claim 18 wherein said vortex-forming mechanism includes respective radius sections located immediately adjacent to, and extending from, said air flow nozzles closest to said lead and trail side walls, the end of each radius section remote from said respective nozzle forming a knife edge.

20. The fusing assembly according to claim 13 wherein said pre-heater housing further includes features to aid in containing the air within said housing, said features including tunnels formed by members extending respectively away from said lead and trail side walls, spaced from and parallel to, said receiver member travel path that serve to increase airflow resistance.

* * * * *